US007526829B2

(12) United States Patent
Chang et al.

(10) Patent No.: US 7,526,829 B2
(45) Date of Patent: May 5, 2009

(54) SELF-CLEANING COMFORT HAIR BRUSH AND ROLLER AND SYSTEM FOR SELECTING A BRUSH FROM A PLURALITY OF BRUSHES ACCORDING TO HAIR TYPE

(75) Inventors: Tianyi Chang, Atlanta, GA (US); Kim V. Peterson, Manchester, GA (US); Paul Spitale, Peachtree City, GA (US); Gil Spenser, Griffin, GA (US)

(73) Assignee: Goody Products, Inc., Atlanta, GA (US)

( * ) Notice: Subject to any disclaimer, the term of this patent is extended or adjusted under 35 U.S.C. 154(b) by 639 days.

(21) Appl. No.: 10/876,407

(22) Filed: Jun. 25, 2004

(65) Prior Publication Data

US 2005/0055788 A1 Mar. 17, 2005

Related U.S. Application Data

(60) Provisional application No. 60/482,407, filed on Jun. 25, 2003.

(51) Int. Cl.
*A46B 7/06* (2006.01)
*A46B 3/20* (2006.01)
*A46B 9/08* (2006.01)

(52) U.S. Cl. ..... 15/186; 15/169; 15/201; 132/119; 132/120

(58) Field of Classification Search ..... 15/159.1, 15/160, 186–188, 201, 168, 169; 132/119, 132/120
See application file for complete search history.

(56) References Cited

U.S. PATENT DOCUMENTS 2,482,928 A * 9/1949 Neff et al. ..... 601/137
2,963,729 A * 12/1960 Thonbo et al. ..... 15/176.1
3,739,419 A 6/1973 Natman et al.
4,114,222 A * 9/1978 Serediuk ..... 15/186
4,118,823 A * 10/1978 Axelrod ..... 15/176.6
4,475,563 A * 10/1984 Martin ..... 132/136
4,479,501 A 10/1984 Chern
4,567,905 A 2/1986 Stewart et al.
4,574,416 A 3/1986 Stewart et al.
4,596,261 A 6/1986 Renda et al.

(Continued)

FOREIGN PATENT DOCUMENTS

CA 2212920 3/1999

(Continued)

*Primary Examiner*—Mark Spisich
(74) *Attorney, Agent, or Firm*—Gardner Groff Greenwald & Villanueva, Inc.

(57) ABSTRACT

A hair brush includes a body, a cushion pad, and a plurality of bristles. The body includes at least a partial cavity at a first end, and the cavity includes a front portion, a rear portion, and a plurality of apertures. A cushion pad having a first surface is disposed near the front portion of the cavity when the hair brush is in a user position, and is disposed near a second surface located near the rear portion of the cavity when the hair brush is in a cleaning position. The plurality of bristles are disposed on the cushion pad, and have a first end that bristles extend substantially perpendicular from the first surface of the cushion pad through the apertures in the front portion of the body.

22 Claims, 9 Drawing Sheets

U.S. PATENT DOCUMENTS

| | | | |
|---|---|---|---|
| 4,932,425 | A | 6/1990 | Chen |
| 4,987,633 | A | 1/1991 | Heneveld |
| 5,095,892 | A | 3/1992 | Tsumura |
| 5,261,426 | A | 11/1993 | Kellett et al. |
| 5,327,611 | A | 7/1994 | Balster et al. |
| 5,483,719 | A | 1/1996 | Ikemoto et al. |
| 5,519,912 | A | 5/1996 | Kawamura |
| 5,815,877 | A | 10/1998 | Heneveld |
| 5,862,563 | A | 1/1999 | Hartmann |
| 5,887,600 | A | 3/1999 | Wilk |
| 5,975,089 | A | 11/1999 | Simon |
| 6,006,395 | A | 12/1999 | Tiramani et al. |
| 6,014,976 | A | 1/2000 | Denebeim |
| 6,021,542 | A | 2/2000 | Norman |
| 6,029,307 | A | 2/2000 | Baudoin |
| 6,070,594 | A | 6/2000 | Mears |
| 6,070,597 | A | 6/2000 | Motherhead |
| 6,341,611 | B1 | 1/2002 | Nakamura |
| 6,382,216 | B1 | 5/2002 | Clark |
| 6,408,475 | B1 | 6/2002 | Morrison |
| 6,438,785 | B1 | 8/2002 | Smith |
| 6,631,831 | B1 | 10/2003 | Loiselle |
| 6,968,848 | B2 | 11/2005 | Grant et al. |
| 7,010,827 | B2 * | 3/2006 | Kim ..... 15/186 |
| 2001/0001887 | A1 | 5/2001 | Bigio |
| 2002/0078971 | A1 | 6/2002 | Anderson |
| 2003/0000900 | A1 | 1/2003 | Yu |

FOREIGN PATENT DOCUMENTS

| | | | |
|---|---|---|---|
| DE | 2923740 | | 12/1980 |
| DE | 8319974.8 | | 12/1983 |
| DE | 3602052 | A1 | 7/1987 |
| DE | 4127758 | A1 | 2/1993 |
| EP | 0168099 | A2 | 5/1986 |
| EP | 185284 | | 6/1986 |
| EP | 0240006 | A2 | 10/1987 |
| EP | 0882414 | A2 | 5/1998 |
| FR | 2482842 | | 11/1981 |
| GB | 191228155 | A | 1/1913 |
| GB | 191408334 | A1 | 6/1914 |
| GB | 794594 | | 5/1958 |
| JP | 3-212208 | * | 9/1991 |

* cited by examiner

SELF-CLEANING COMFORT HAIR BRUSH AND ROLLER AND SYSTEM FOR SELECTING A BRUSH FROM A PLURALITY OF BRUSHES ACCORDING TO HAIR TYPE

RELATED APPLICATION DATA

The present application is a non-provisional application based on, and claiming the priority benefit of, U.S. provisional application Ser. No. 60/482,407, which was filed on Jun. 25, 2003, and is expressly incorporated by reference herein.

FIELD OF THE DISCLOSURE

The disclosure relates generally to hair brushes, hair rollers, and a system of hair brushes for use with various types of hair and, more particularly, to hair brushes having comfort features and self-cleaning retractable bristles, and to a system for selecting a hair brush from a plurality of hair brushes according to types and styles of hair.

BACKGROUND OF THE DISCLOSURE

Hair brushes in general are known in the art. Similarly, hair brushes having retractable bristles or self-cleaning features, and features for added comfort are also know in the art. For example, one type of a self-cleaning hair brush is disclosed in U.S. Pat. No. 6,021,542, and includes a plurality of cleaning sheets disposed between bristles of the brush. After strands of hair have accumulated between the bristles, the user can pull a sheet away from the plurality of sheets, thereby removing with the sheet the accumulated strands of hair. This type of self-cleaning hair brush, however, requires the plurality of sheets to be replaced, making it a costly brush cleaning feature.

Another type of self-cleaning hair brush includes retractable bristles that enable the user to remove strands of hair from a top of the brush once the bristles have been retracted. One such brush is disclosed in U.S. Pat. No. 4,574,416 and utilizes a brush head, a spring, and a lever to retract the bristles relative to the head of the brush. More specifically, the brush head is disposed at an end of the lever which pivots about a pivot point in the body of the brush. The spring biases the lever and hence the bristle head to a position such that the bristles of the brush are in a retracted position. The user extends the bristles for use by depressing the lever against the bias of the spring and forcing the bristles out from the head of the brush.

Another brush having retractable bristles is disclosed in U.S. Pat. No. 5,815,877 and includes a base, an actuation member, and a plurality of bristles. The bristles are attached to the actuation member which is slidably attached to the base. The bristles are retracted by pulling the actuation member toward the user relative to the base. By doing so, the bristles, which are positioned perpendicular to the actuation member in the extended position, are forced to a parallel position relative to the actuation member and hence are retracted into the base/actuation member. The bristles are extended by pushing the actuation member into the base, thereby positioning the bristles perpendicular to the actuation member.

Another brush having retractable bristles is disclosed in U.S. Pat. No. 5,862,563 and includes body, a backing member, springs, a base, an actuating element, and a plurality of bristles. The bristles are attached to the backing member, which is operatively attached to the actuating element. The springs are located underneath and bias the backing member against the body of the brush such that the bristles extend from the body. The bristles are retracted into the body by depressing the actuating element against the bias of the springs. To extend the bristles from the body, the user releases the depressed actuating element such that the bias of the springs returns the backing member against the body of the brush, and hence extends the bristles.

Another brush having retractable bristles is disclosed in U.S. Pat. No. 5,862,563 and includes an outer tubular member having apertures and an inner tubular member. A plurality of bristles are rotatably mounted on the inner tubular member and extend through the apertures. By rotation of the outer tubular member relative to the inner tubular member, the bristles, depending on the direction of rotation, either extend from or retract into the outer tubular member.

These types of retractable bristle/self-cleaning hair brushes, however, each have one or more problematic aspects or features. For example, these brushes all require a complicated and multi-piece mechanism to effectuate retraction and extension of the bristles, making the brushes costly to manufacture and more susceptible to breakage and malfunction. Similarly, these brushes are not designed for the comfort of the user and, therefore, have features not optimal for user comfort.

In another example, a comfort hair brush is disclosed in U.S. Pat. No. 6,006,395 and includes a flexible membrane that is pivotally attached along opposite ends to a rigid support. A plurality of bristles are attached to and extend downwardly from the flexible membrane. During use of the brush, the flexible membrane will reconfigure to match a profile of the user's head and will provide a certain amount of forgiveness toward the center portion of the flexible membrane. This comfort hair brush, however, does not include any self-cleaning features, and may be hard on the head of the user at areas toward the ends of the flexible membrane

SUMMARY OF THE DISCLOSURE

In accordance with one aspect of the disclosure, a hair brush having a body, a cushion pad, and a plurality of bristles, is disclosed. The body includes a first end at which at least a partial cavity is disposed. The cavity includes a front portion, a rear portion, and a plurality of apertures. The cushion pad includes a first surface that is disposed near the front portion of the cavity when the hair brush is in a user position, and a second surface that is disposed near the rear portion of the cavity when the hair brush is in a cleaning position. The plurality of bristles are disposed on the cushion pad such that a first end of the bristles extends substantially perpendicular from the first surface of the cushion pad through the apertures in the front portion of the cavity.

In accordance with another aspect of the disclosure, a hair brush having a body, a central elongate portion and a plurality of bristles is disclosed. The body includes a generally cylindrical portion having an outer surface and a plurality of apertures, wherein the generally cylindrical portion is disposed near the first end of the body. The central elongate portion includes a first end and a second end, and is disposed at least partially inside the cylindrical portion. Each of the plurality of bristles has a first end that extends from the central elongate portion through a corresponding one of the apertures in the cylindrical portion of the body. A second end of each of the plurality of bristles is disposed near the outer surface of the cylindrical portion in a cleaning position, and is disposed away from the outer surface of the cylindrical portion in a user position.

In accordance with another aspect of the disclosure, a hair brush having a body, a head, and a plurality of bristles is disclosed. The head is disposed near a first end of the body, and the plurality of bristles are disposed on the head of the body. A bristle density and bristle length are based on at least one of a length, texture, amount, and thickness a hair type.

In accordance with another aspect of the disclosure, a hair brush system having a plurality of brushes is disclosed. The plurality of hair brushes each have different types of bristles and include a first of the plurality of hair brushes having a first type of bristles adapted to be used with a first type of hair, and a second of the plurality of hair brushes having a second type of bristles adapted to be used with a second type of hair. The first type of bristles and the second type of bristles differ in at least one of a bristle density and a bristle length.

In accordance with another aspect of the disclosure, a method of providing hair brushes for various types of hair is disclosed. The method includes providing a first hair brush having a first type of bristle adapted to be used with a first type of hair, and a second hair brush having a second type of bristle adapted to be used with a second type of hair. The first type of bristles and the second type of bristles differ in at least one of a bristle density and a bristle length.

In accordance with another aspect of the disclosure, a method of determining hair brushes for various types of hair is disclosed. The method includes categorizing hair types based on at least one of a length, texture, amount, and thickness of hair, and providing a plurality of hair brushes having a different bristle type. The method further includes correlating a first hair type to a first of the plurality of hair brushes having a first bristle type, and correlating a second hair type to a second of the plurality of hair brushes having a second bristle type. The first bristle type and the second bristle type differ in at least one of a bristle density and a bristle length.

In accordance with another aspect of the disclosure, a hair roller is disclosed. The hair roller includes a generally cylindrical body, a central elongate portion, and a plurality of bristles. The generally cylindrical body includes an outer surface and a plurality of apertures, and the central elongate portion has a first end and a second end and is disposed at least partially inside the cylindrical portion. The plurality of bristles have a first end that extend from the central elongate portion through the apertures in the body, and a second end that are disposed near the outer surface of the body in a cleaning position, and are disposed away from the outer surface of the body in a user position.

In accordance with another aspect of the disclosure, a vented hair brush is disclosed. The vented hair brush includes a body having a head and a handle, at least a partial cavity disposed in the head of the brush, a cushion pad, and a plurality of bristles. The cavity has a front portion, a rear portion, and at least a first plurality of apertures. The cushion pad includes a first surface disposed near the front portion of the cavity when the hair brush is in a user position, a second surface disposed near the rear portion of the cavity when the hair brush is in a cleaning position, and a second plurality of apertures aligned with the first plurality of apertures when the hair brush is in a user position. The plurality of bristles are disposed on the cushion pad and have first ends that extend substantially perpendicular from the first surface of the cushion pad through a third plurality of apertures disposed in the head of the brush.

BRIEF DESCRIPTION OF THE DRAWINGS

The advantages of the present invention will be apparent upon reading the following description in conjunction with the drawings, in which.

Figure 1:
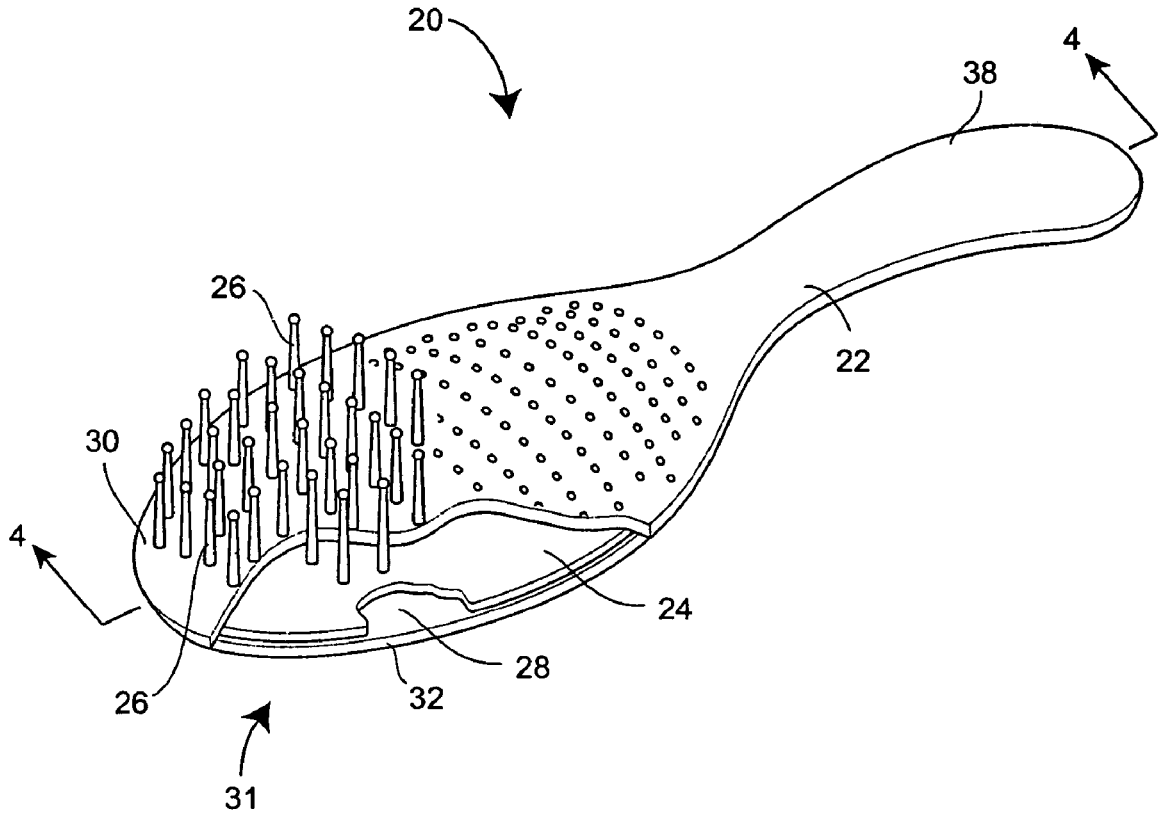
FIG. 1 is perspective view of one embodiment of a self-cleaning comfort hair brush constructed in accordance with the teachings of the disclosures.

While the invention is susceptible to various modifications and alternative constructions, certain illustrative embodiments thereof have been shown in the drawings and will be described below in detail. It should be understood, however, that there is no intention to limit the invention to the specific forms disclosed, but, on the contrary, the intention is to cover all modifications, alternative constructions, and equivalents falling within the spirit and scope of the disclosure and the appended claims.

DETAILED DESCRIPTION

Referring now to the drawings, and with specific reference initially to FIG. 1, a self-cleaning comfort hair brush 20 includes a body 22, a cushion pad 24, and a plurality of bristles 26. The hair brush 20, as depicted in FIG. 1 is only one exemplary type of hair brush 20 and, more particularly, one exemplary type of hair brush head that may be used in conjunction with the present disclosure. The hair brush 20 is, therefore, not limited to an oval-shaped brush head as depicted in FIG. 1, but may include any of the brush heads disclosed herein and others.

Figure 2:
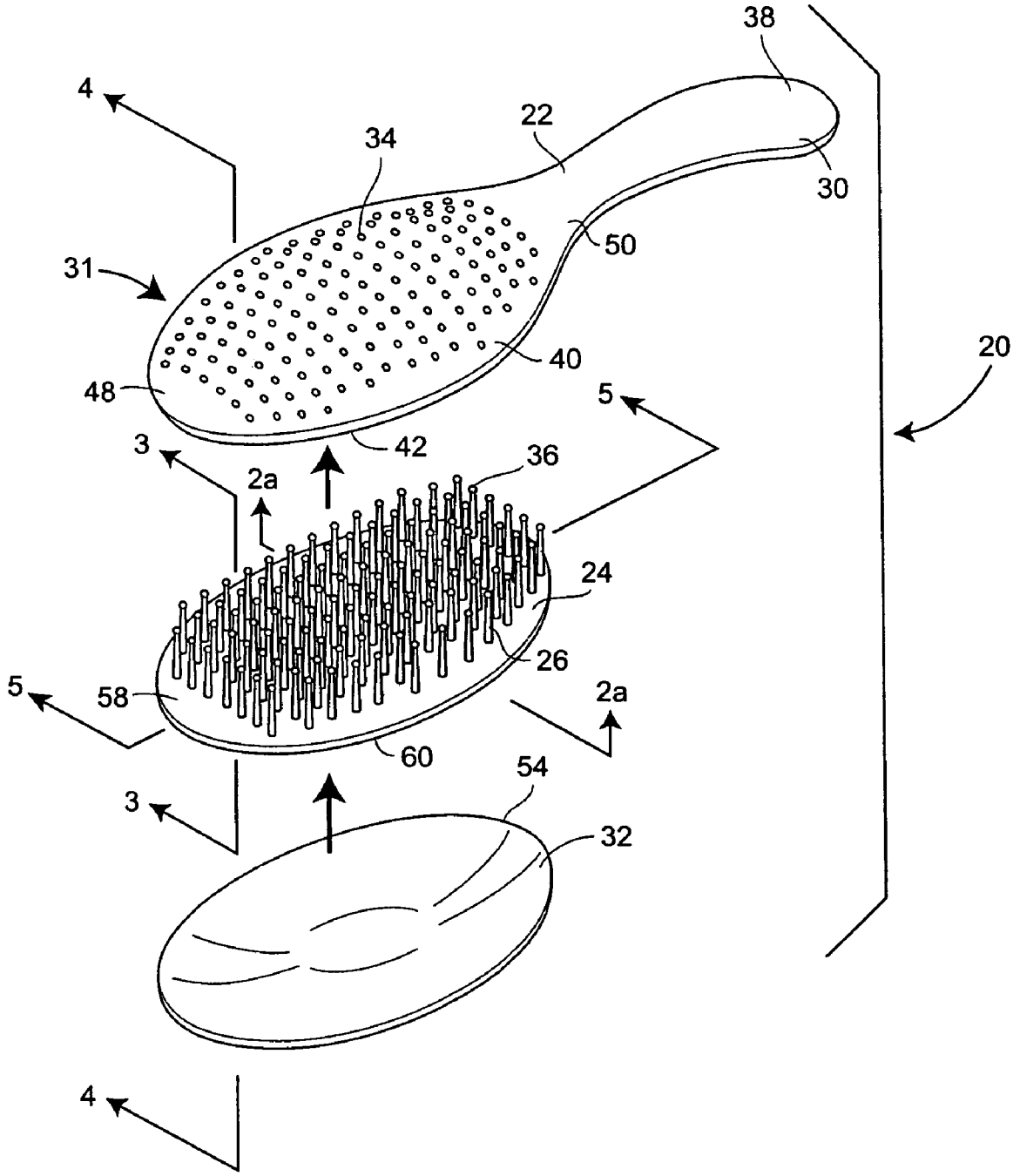
FIG. 2 is an exploded perspective view of the self-cleaning comfort hair brush of FIG. 1.
Figure 4:
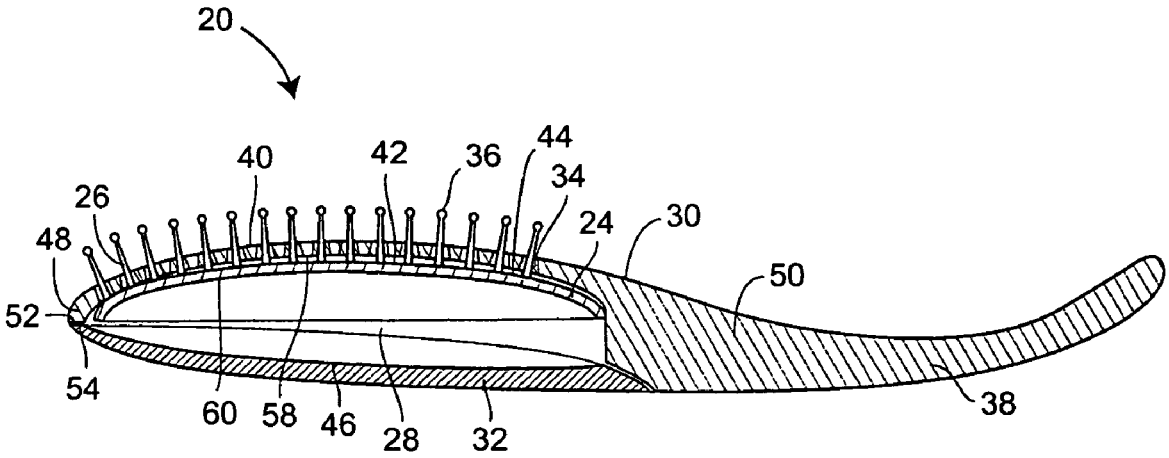
FIG. 4 is a cross-sectional view of the self-cleaning comfort hair brush of FIG. 1, in a user position.

The hair brush 20 is intended to provide a comfortable brush that is self-cleaning and/or has a self-cleaning mechanism. More specifically, the bristles 26 are attached to and extend substantially or generally perpendicularly from the cushion pad 24 located in a cavity 28, as illustrated in FIGS. 2 and 4. The cushion pad 24 is constructed from a flexible material, and can be moved such that it is disposed near a front portion 30 of the body 22 with bristles extending outwardly through aperture 34 when the hair brush 20 is in an user position, or is disposed near a rear portion 32 of the body 22 when the hair brush 20 is in a cleaning position. The bristles 26 extend through apertures 34 located on the front portion 30 of the body 22, such that tips 36 of the bristles 26 are disposed away from the front portion 34 in a user position, and are disposed near the front portion 30 or at least partially retracted within the cavity 28 in a cleaning position.

A hair brush system incorporating various features of the hair brush 20 is intended to provide a hair brush 20 selectable from an array of brushes and adapted for a person's specific type and/or style of hair. More specifically, the user's hair type may be categorized in many ways including, but not limited to, amount or density, shape, width or diameter, and length of the hair. Similarly, the person's hair style may vary. A brush with the length and density of the bristles 26, as illustrated in FIGS. 8-17 may, therefore, be appropriately chosen to accommodate the various type and style of hair.

In one exemplary embodiment as illustrated in FIGS. 1-2, the body 22 includes a head 31 defining the cavity 28 therein, and a handle 38. The handle 38 extends from the front portion 30, and the cavity 28 is disposed between the front portion 30 and the rear portion 32 at the body 22. The hair brush 20 may, however, be constructed without the handle 38, such that the user would grasp, for example, the head 31 of the brush 20 during use. Conversely, the hair brush 20 may include several additional elements or pieces. For example, the handle 38 may be constructed from a plurality of pieces; similarly, the front and rear portions 30, 32 may be constructed of additional pieces and/or be connected at other locations. The front portion 30 of the body 22 has an outside surface 40 and an inside surface 42, wherein the apertures 34 are located between the inside surface 42 and the outside surface 40. The inside surface 42 of the front portion 30 may also define an upper surface or front wall 44 of the cavity 28. A rear wall 46 of the cavity 28 defined by an inner surface of rear portion 32 is disposed opposite the front wall 44.

The body 22 may be constructed from one or more pieces and, as in this example, may be constructed from two portions, the front portion 30 and the rear portion 32. The front portion 30 may include the handle 38, and may in part create the front wall 44 of the cavity 28. The rear portion 32 of the body 22 may be disposed to the rear of the front portion 30, such that the rear portion 32 may in part create the rear wall 46 of the cavity 28.

Figure 5:
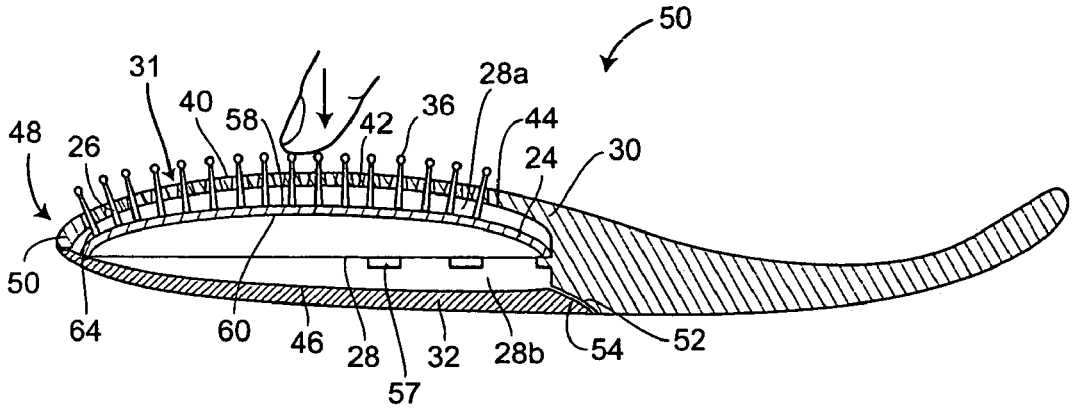
FIG. 5 is a cross-sectional view of the self-cleaning comfort hair brush of FIG. 2 in a cleaning position.

More specifically, as best illustrated in FIGS. 2 and 5, the front portion 30 includes a first end 48 and a second end 50. The first end 48 of the front portion 30 includes the apertures 34 and a first mating surface 52, and the second end 50 includes the handle 38. The first mating surface 52 is located around the perimeter of a first section 28*a* of the cavity 28 and may be adapted to receive a second mating surface 54 located on the rear portion 32 of the body 22. The rear portion 32 may create a second section 28*b* of the cavity 28 and may include the second mating surface 54. The second mating surface 54 is located around the perimeter of the rear portion 32 of the body 22, and may be adapted to engage with the first mating surface 52, such that upon connection of the mating surfaces 52, 54, the cavity 28 is formed.

Figure 2A:
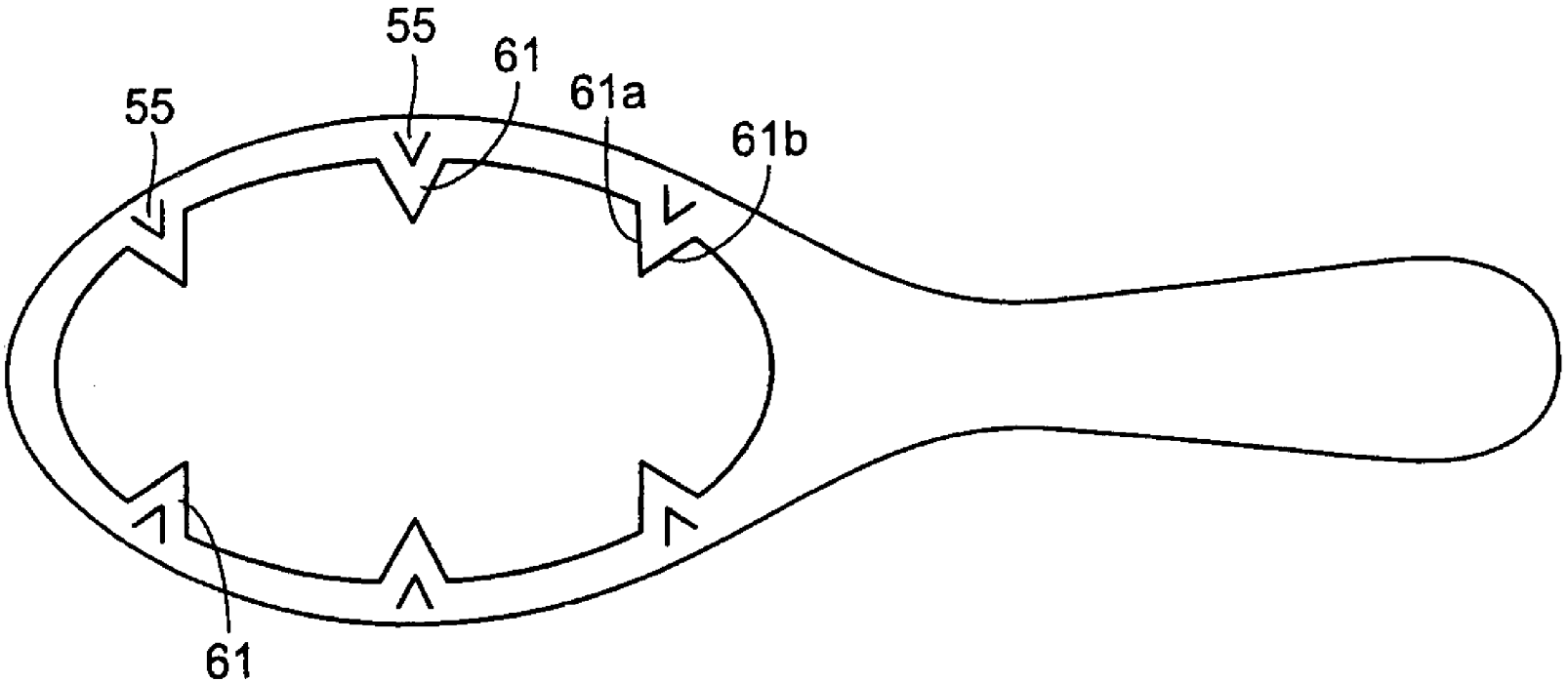
FIG. 2*a* is a plan view of the comfort hair brush taken along line 2*a*-2*a* of FIG. 2.

The body 22 may also include one or more positioning members 55, located along the perimeter of the cavity 28, as seen in FIG. 2*a*. The positioning members 55 may depend from the perimeter of the cavity 28 and extend radially inward.

The body 22 and the cavity 28 may, however, be formed in many other ways with many additional and/or alternate features. For example, the front portion 30 and the rear portion 32 may be attached or engaged via a ledge and corresponding recess. More specifically, the mating surfaces 52, 54 may include a complimentary ledge and recess, such that the rear portion 32 may snap onto the front portion 30 via the ledge and recess, without adhesive. Similarly, the hair brush 20 may be constructed from a single piece and may not include the rear portion 32. The cavity 28 in such an example, may only be partially enclosed. Other methods of forming the body 22 and cavity 28 may include connecting the front portion 30 and the cushion pad 24 together without a rear portion 32 where the cushion pad 24 is attached to the front portion 30. The cushion pad 24 may be constructed by other materials listed below. The cushion pad 24 can also be constructed in pieces with mobile joints that allows movement, with the movement being enhanced or regulated by additional material such as gel-like substance, water, plasmic type of material that is behind the cushion pad 24, and granular substance such as sand, marble, or dust. These materials may require glue or adhesives to retain its position relative to the cushion pad 24, and may or may not require a rear cavity 32 to contain itself. The rear portion 32 can be eliminated or constructed together with the front portion 30 as a whole part. The substances behind the cushion pad 24 may be functional in nature or aesthetic. In addition the front portion 30 is not required to have a dome-like curvature. The front portion 30 can also be of a flat surface, textured surface, ribbed with undulating wall thicknesses, or include additional material that creates a textured feel. For example, the front wall 44 of the front portion 30 may include a molded rubber for texture, or an oil absorbing fabric, and may be decorative and ornamental as well.

Figure 10:
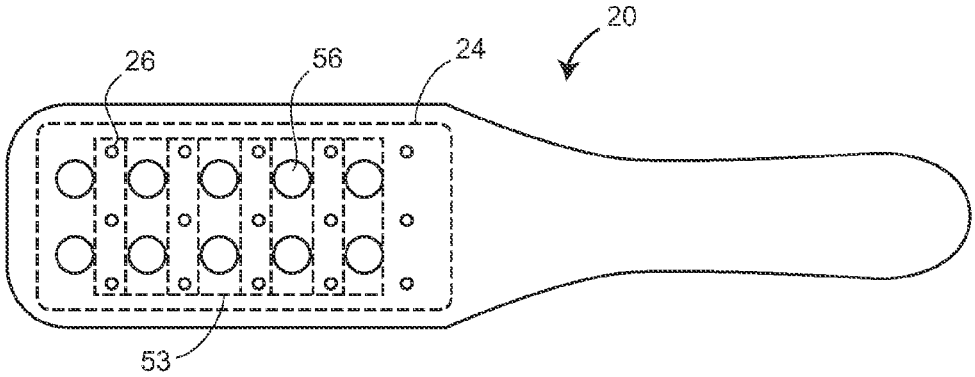
FIG. 10 is a front plan view of a low-density bristle pattern of a vented brush.
Figure 13:
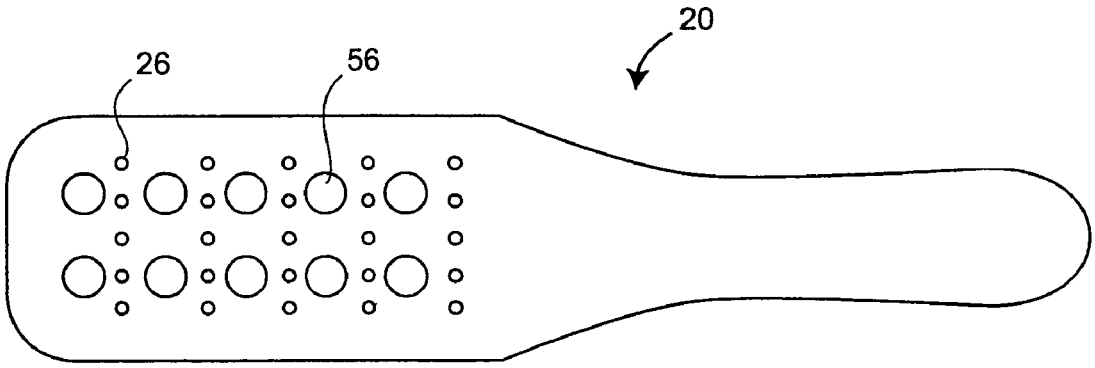
FIG. 13 is a front plan view of a medium-density bristle pattern of a vented brush.
Figure 16:
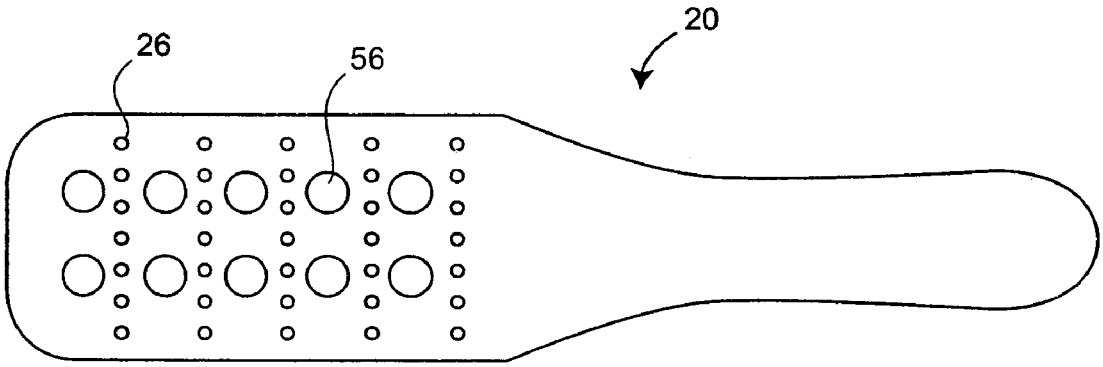
FIG. 16 is a front plan view of a high-density bristle pattern of a vented brush.

In another example, the body 22 may include additional apertures 56 both on the front and rear portions 30, 32, as seen in FIGS. 10, 13, and 16, such that air (i.e., from a hairdryer) may penetrate the head of the hair brush 20. Similarly, the cushion pad 24 may include additional apertures 53 corresponding to the apertures 56, as seen in FIG. 10, such that air may penetrate the cushion pad 24. The apertures 53, as seen in FIG. 10, may be slots or cu-outs from the cushion pad 24, thereby allowing air may penetrate the cushion pad 24. Alternatively, the apertures 53 may in fact create separations in the cushion pad 24, such that the cushion pad 24 is constructed from a plurality of strips or pieces that contain the bristles 26.

The body 22 can be fabricated from relatively light weight, durable, and sturdy plastic materials such as polyethylene, polypropylene, polystyrene, or other suitable plastic materials, including but no limited to wood, metal, and composites. Similarly, the body 22 can be injection molded, blow molded, continuously molded, extruded, vacuum formed, or the like. The manufacturing process or processes and materials can be selected based on feasibility, cost, tooling concerns, as well as other factors for a given application. The optimal method of manufacturing is to use injection molding to form the front and rear portions 30, 32. The bristles 26 and cushion pad 24 can be simultaneously molded through injection molding with the bristles 26 being contained within the cushion pad 24. Alternatively, the bristles 26 may be molded separately and assembled in a molded cushion pad 24 and reinforced with glue or fabric to further stabilize the bristles 26 to prevent bristles 26 from depressing through the cushion pad 24.

The cushion pad 24, as illustrated in FIGS. 2, 4, and 5, is disposed within the cavity 28 and includes a front surface 58 and a rear surface 60 that, in this example, are substantially parallel to each other. The cushion pad 24, when in use, may have a generally convex shape, which may be the result of placement of the cushion pad 24 into the cavity 28 and/or the body 22. More specifically, the cushion pad 24 may be constructed or formed such that the cushion pad 24 has a generally convex shape independent of the cavity 28 and the body 22. The cushion pad 24 may alternatively be constructed or formed such that the cushion pad 24 has a generally planar shape and only obtains its convex shape once inserted into the cavity 28 and/or the body 22.

In one exemplary embodiment, at least a portion of a perimeter of the cushion pad 24, as seen in the left portion of the head 31 in FIG. 5, may rest on the front or rear portion 30, 32 of the hair brush 20, thereby providing the cushion pad 24 and, more specifically, the perimeter of the cushion pad 24 a stop or the like, to enable the cushion pad 24 to retain the convex shape. Additionally and/or alternatively, as seen in the right portion of the head 31 in FIG. 5, at least a portion of the perimeter of the cushion pad 24 may rest on a ledge or protrusion 57 extending inwardly from the front or rear portion 30, 32 toward the cavity 28. The perimeter of the cushion pad 24, however, need not abut a stop or the like to enable the cushion pad 24 to retain the convex shape, but may retain the convex shape by some other means such as, for example, the engagement of the bristles 26 with the apertures 34.

Once having a convex shape, the cushion pad 24, in this example, is biased to remain in the convex shape, due to the construction or placement of the cushion pad 24 in the cavity 28 and/or body 22. The rear surface 60 of the cushion pad 24 may be disposed along the rear wall 46 of the cavity 28 when the hair brush 20 is in the cleaning position, such that the cushion pad 24 may have a substantially similar contour to the rear wall 46 of the rear portion 32. The cushion pad 24 may be fabricated from relatively resilient and flexible materials such as rubber, fabric, plastic with high pliability, or plastic connected by joints to enable movement, paper-like material such as vellum, mylar, acetate, metal with high pliability in sheets or connected by joints, wooden pieces connected by joints to enable movement, or other suitable flexible material, or any material joined or designed to create flexible movement.

Additionally, the cushion pad 24 may include holes, ribs, slots, and/or other features to locally effect the flexibility of the cushion pad 24. For example, as seen in FIG. 2*a*, the cushion pad may include one or more relieves, such as angled cut-outs 61 as in this embodiment. The angled cut-outs 61 are located at the perimeter of the cushion pad 24, and extend inwardly. The angled cut-outs 61 may allow the cushion pad 24 to conform to the front portion 30 without overlapping parts. More specifically, the angled-cuts may allow the cushion pad 24 to conform to a convex and/or concave shape as defined by the cavity 28.

Figure 3:
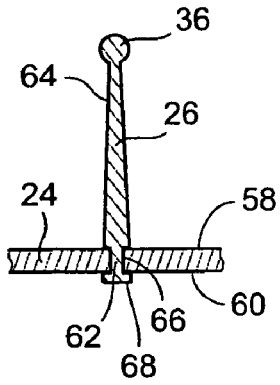
FIG. 3 is a cross-sectional view of a portion of a cushion pad and bristles taken along line 3-3 of FIG. 2.

The bristles 26, as illustrated in FIGS. 3 and 4, extend substantially perpendicular to the cushion pad 24 and include a first end 62 and a second end 64, wherein the second end 64 includes the tip 36. The first end 62 of the bristles 26 are adapted to fixedly or removably attach to the cushion pad 24, and the second end 64 of the bristles 26 are adapted to contact the user's scalp. More specifically, the first end 62 of the bristles 26 may include an annular groove 66 and a flange 68, which are arranged such that to one side of the groove 66 is the flange 68 and to the other side of the groove 66 is the remainder of the bristle 26. As seen in FIG. 3, the annular groove 66 engages the cushion pad 24 and is secured by the flange 68 at the rear surface 60 of the cushion pad 24, and by the remainder of the bristle 26 on the front surface 58 of the cushion pad 24. The bristle 26, may however, be attached to the cushion 24 in other manners, including, but not limited to, adhesive, press-fit, interference-fit, or the like, or can be removably attached and be replaceable. Additionally, the bristles 26 may be integrally molded with the cushion pad 24, in a one step or two step molding process. The second end 64 of the bristles 26 includes the tip 36 which may include a feature adapted to make the hair brush 20 more comfortable on the user's scalp. In this exemplary embodiment, the tip 36 is rounded or spherically shaped, which makes engagement with the user's scalp less harsh and more comfortable than without. The length of the bristles 26 may be constant throughout the hair brush 20, but may also vary according to need and design, such that the tips 36 of the bristled 26 are staggered and not equidistant to the outside surface 40 of the front portion 30.

In operation, the hair brush 20 has several positions, including a user position and a cleaning position. In the user position, as illustrated in FIG. 4, i.e. as the user is brushing hair, the front surface 58 of the cushion pad 24 is disposed substantially along the inside surface 42 of the front portion 30 of the body 22, such that the bristles 26 extend outwardly from the front surface 58 of the cushion pad 24 through the apertures 34. As such, the tips 36 of the bristles 26 are disposed away from the outside surface 40 front portion 30 of the body 22.

However, as the hair brush 20 and, more specifically, as the bristles 26 come into contact with the user's scalp, the front surface 58 of the cushion pad 24 may be forced away from the inside surface 42 of the portion 30 of the body 22, such that cushion pad 24 is forced from the initial convex shape to a less convex shape, a planar shape or even a concave shape, as illustrated in FIG. 5. More specifically, to make using the hair brush 20 more comfortable, the cushion pad 24 may be designed to absorb a force and/or distance that is in excess of the force and/or distance required to make contact between the bristles 26 and the user's scalp. The cushion pad 24, having a generally convex shape may, therefore, temporarily deform to accommodate the extra force and/or distance that is in excess of the force and/or distance required to make contact between the bristles 26 and the user's scalp.

In a cleaning position, the rear surface 60 of the cushion pad 24 is disposed substantially along the rear surface 86 of the cavity 28, such that the tips 36 of the bristles 26 are disposed near the outside surface 40 of the front portion 30.of the body 22. More specifically, to make cleaning accumulated strands of hair from the bristles 26 easier, the cushion pad 28 is deformed or moved to cause the bristle 26 to at least partially retract into the front portion 30 and/or the body 22. As illustrated in FIG. 5, the user may depress the bristles 26 into the front portion 30 and/or the body 22, thereby causing the bristles 26 to retract, causing the cushion pad 24 to deform. Upon retraction, the hair is accumulated at a top of the apertures 34 as the hair is prevented from moving with the bristles 26 by the stationary front portion 30.

The cushion pad 24 may move within the cavity 28 by many methods. In one method, the cushion pad 24 may be suspended between the two cavities 28*a*, 28*b*. Due to the nature of rubber material, the cushion pad 24 conforms to the first cavity 28*a* of the hair brush 20. When the rubber is depressed, due to the nature of the material, the cushion pad 24 has a natural tendency to flex, depress and remit to its original shape.

The position members 55 and/or the angled cut-outs 61 may aid in the flexing and/or aligning of the cushion pad 24. For example, as the cushion pad 24 flexes either convexly or concavely, the perimeter of the cushion pad 24 may have a tendency to compress and/or bunch. The angled cut-outs 61 may allow the cushion pad 24 variable flexibility depending of the size of the angled cut-outs 61 and/or the positioning members 55. In combination, the positioning members 55 and the angled cut-outs 61 may align the cushion pad 24 in the cavity 28, and hence relative to the front portion 30 having the apertures 34. More specifically, as illustrated in FIG. 2*a*, the positioning members 55 and the angled cut-outs 61 may engage, such that the sides 61*a* and 61*b* of the angled cut-outs 61 are disposed on either side of the positioning members 55. As such, the cushion pad 24 will be aligned in the cavity 28, and hence the front portion 30 and apertures 34.

Figure 6:
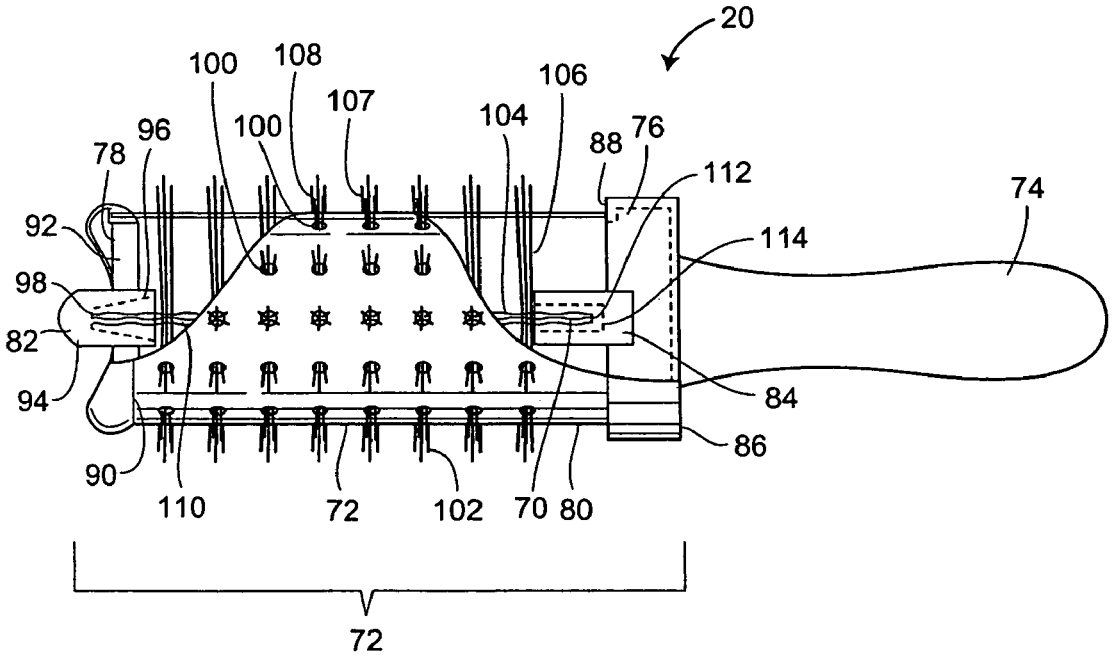
FIG. 6 is a side view with broken out sections of a round self-cleaning comfort hair brush in a user position.
Figure 7:
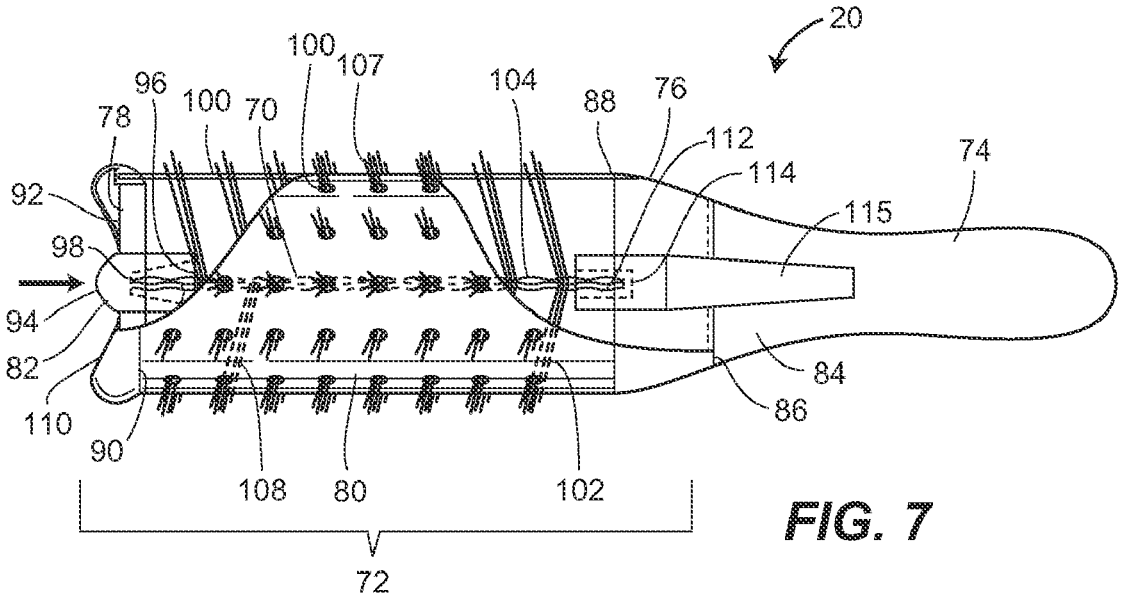
FIG. 7 is a side view with broken out sections of the round self-cleaning comfort hair brush of FIG. 6 in a cleaning position.
Figure 7A:
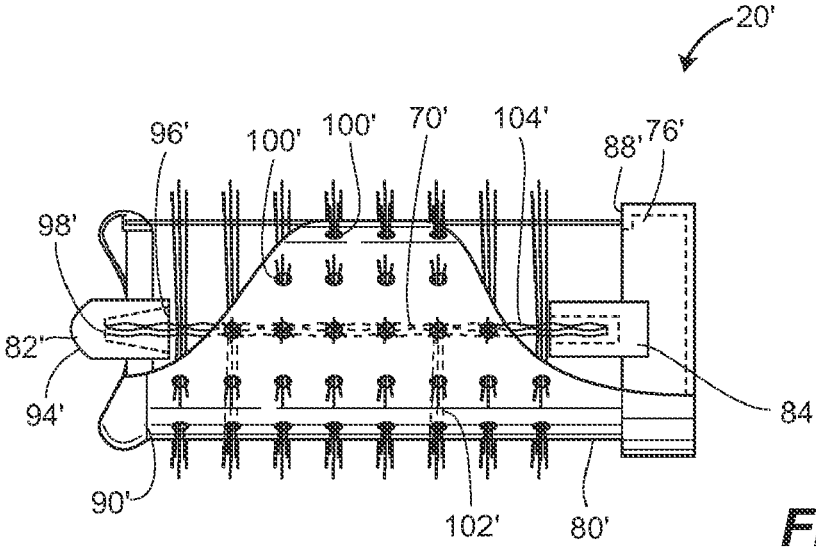
FIG. 7*a* is a side view with broken out sections of a round self-cleaning comfort hair roller in a user position.

In another exemplary embodiment illustrated in FIGS. 6 and 7, the hair brush 20 may not include a cushion pad 24, but may include an elongate central axis rod 70. In this embodiment, a body 72 may include a handle 74, a first end cap 76, a second end cap 78, a central annular portion 80 located between the first end cap 76 and the second end cap 78, an activation button 82, and a receiving portion 84. The handle 74 depends from a first side 86 of the first end cap 76. A second side 88 of the first end cap 76 includes a circular recess portion that receives the central annular portion 80. The first end cap 76 and the handle 74 may, however, be an integral unit (FIG. 7) and may be constructed such an exterior surface of the first end cap 76 and an exterior surface of the central annular portion 80 are substantially planar or flat, such that no observable step between the first end cap 76 and the central annular portion 80 exists. A first side 90 of the second end cap 78 receives the other end of the central annular portion 80 and, more specifically, receives the central annular portion 80 within a circular recess. The second end cap 78 may be constructed such an exterior surface of the second end cap 78 and an exterior surface of the central annular portion 80 are substantially planar or flat (FIG. 7), such that no observable step between the second end cap 78 and the central annular portion 80 exists. The activation button 82 is located along the central longitudinal axis of the central annular portion 80 within the second end cap 78. More specifically, the activation button 82 includes a first end 94 and a second end 96, wherein the first end 94 is adapted to be engaged by a user, and the second end 96 includes a cup portion 98 adapted to receive the elongate central axis rod 70.

The central annular portion 80 may be generally cylindrical and, more specifically, may have a generally circular cylindrical shape. A plurality of apertures 100 located around the central annular portion 80 receive bristles 102 that are disposed from the elongate central axis rod 70 through the apertures 100.

The elongate central axis rod 70 may have a semi-rigid to rigid construction from which the bristles 102 extend. More specifically, as in this example, the elongate central axis rod 70 is constructed from a plurality of rods or wires 104 that are twisted together to form the elongate central axis rod 70. The elongate central axis rod 70 may, however, be molded using various types of molding techniques, including being integrally molded with the bristles 102.

The bristles 102 extend radially outward from the elongate central axis rod 70 and are fixedly attached thereto. In this example, the bristles 102 are attached to the elongate central axis rod 70 by being wedged between the rods 104 as the rods 104 are twisted together. More specifically, prior to the rods 104 being twisted together, the bristles 102 may be placed between the rods 104, such that the bristles 102 are oriented generally perpendicular to the rods 104 and such that the bristles 102 abut the rods 104 near an inner section 106 of the bristles 102. Once the rods 104 are twisted and the bristles 102 are wedged therebetween, outer sections 108 of the bristles 102 will extend in substantially equal length from opposite sides of the elongate central axis rod 70. The bristles 102 may, however, have varying length such that the outer sections 108 of the bristles 102 are staggered and not equidistant to the elongate central axis rod 70.

In operation of this exemplary embodiment, the hair brush 20 may be in one or more positions, including the cleaning position and the user position. In the user position, as seen in FIG. 6, the activation button 82 is located in an outward position, such that the activation button 82 extends from a second side 92 of the second end cap 78, and the bristles 102 are oriented substantially perpendicular to the elongate central axis rod 70. In this position, the outer portions 108 of the bristles 102 extend through the apertures 100 and outwardly from the central annular portion 80. The bristles 102 are in their natural state at this point, because the rigidity of the bristles 102 and their attachment to the elongate central axis rod 70 cause the bristles 102 to have a tendency or bias to be substantially perpendicular to the elongate central axis rod 70, and hence in the user position.

The hair brush 20 may be changed from the user position to the cleaning position by depressing the activation button 82. More specifically, the activation button 82 may be depressed, thereby causing the cup portion 98 located on the bottom of the activation button 82 to abut a second end 110 of the elongate central axis rod 70. The elongate central axis rod 70 will move axially along the central axis of the central annular portion 80, until a first end 112 of the elongate central axis rod 70 abuts a bottom 114 of the receiving portion 84. Alternatively, the elongate central axis rod 70 will move axially along the central axis of the central annular portion 80, until a stop (not show) on the activation button 82 prevents further depression of the activation button 82 into the second end cap 78. During movement of the second end 110 of the elongate central axis rod 70 toward the receiving portion 84, walls of the activation button 82 and/or the receiving portion 84 may guide the elongate central axis rod 70 along the longitudinal central axis of the central annular portion 80.

As the elongate central axis rod 70 travels along the longitudinal central axis of the central annular portion 80, the outer portions 108 of the bristles 102 remain in the stationary apertures 100 and the inner portion 106 of the bristles 102 travel with the elongate central axis rod 70. This action thereby causes the bristles 102 to change from a substantially perpendicular orientation relative the elongate central axis rod 70, to an angled orientation. As best illustrated in FIG. 7, the travel of the elongate central axis rod 70 along the central axis of the central annular portion 80 will cause the outer portions 108 of the bristles 102 to retract into the central annular portion 80 until only a minimal length of the outer portion 108 of the bristles 102 extend from the central annular portion 80. Accumulated hair is cleaned from the bristles 102 as the bristles 102 are swiped during movement through the apertures 100.

In another exemplary embodiment, the cleaning mechanism as described above may be altered or varied. The bristles 102 may be retracted or caused to be retracted in several other ways. For example, the first endcap 76, the handle 74, and/or the receiving portion 84 may have axial movement relative to the central annular portion 80. As such, the elongate central axis rod 70 may be fixedly attached to the first endcap 76, the handle 74, and/or the receiving portion 84, thereby also allowing the bristles 102 attached to the elongate central axis rod 70 to move relative to the central annular portion 80. More specifically, the handle 74 may be fixedly attached to the receiving portion 84 and the elongate central axis rod 70, which may all slidably engage the first endcap 76 that may be fixedly attached to the central annular portion 80. In this arrangement the handle 74 may be pushed or pulled relative to the first endcap 76 and the central annular portion 80, thereby causing the bristles 102 to retract and/or extend from the central annular portion 80.

Alternatively, as seen in FIG. 7, receiving portion 84 may be fixedly attached to the elongate central axis rod 70, and the receiving portion 84 may be located in an aperture 115. More specifically, as the elongate central axis rod 70 moves axially within the central annular portion 80, the receiving portion 84 and hence the elongate central axis rod 70 may be guided and aligned by the aperture 115, which may be a tapered hole adapted to slidingly receive the receiving portion 84.

In yet another exemplary embodiment, the mechanisms of the hair brush 20 previously described may be used in a hair roller 20'. The hair roller 20' may include a first end cap 76', a second end cap 78', a generally cylindrical body 80' located between the first end cap 76' and the second end cap 78', an activation button 82', and a receiving portion 84'. A second side 88' of the first end cap 76' includes a circular recess portion that receives the generally cylindrical body 80'. A first side 90' of the second end cap 78' receives the other end of the generally cylindrical body 80' and, more specifically, receives the generally cylindrical body 80' within a circular recess. The activation button 82' is located along the central longitudinal axis of the generally cylindrical body 80' within the second end cap 78'. More specifically, the activation button 82' includes a first end 94' and a second end 96', wherein the first end 94' is adapted to be engaged by a user, and the second end 96' includes a cup portion 98' adapted to receive a elongate central axis rod 70'. A plurality of apertures 100' located around the generally cylindrical body 80' receive bristles 102' that are disposed from the elongate central axis rod 70' through the apertures 100'.

The elongate central axis rod 70' may have a semi-rigid to rigid construction from which the bristles 102' extend. More specifically, as in this example, the elongate central axis rod 70' is constructed from a plurality of rods or wires 104' that are twisted together to form the elongate central axis rod 70'. The bristles 102' extend radially outward from the elongate central axis rod 70' and are fixedly attached thereto.

The hair brush system includes a plurality of hair brushes 20, wherein each hair brush 20 may have a self-cleaning feature and may be optimized for comfort, as described above. The plurality of brushes are customized for different types and/or styles of hair.

For example, the user's type of hair may be described in many ways including, but not limited to, the length of the hair, the amount or density of hair, the shape of the hair, and the thickness or shape of the diameter of the hair strands. The length of the user's hair, as measured from the scalp of the user to the ends of the strands of hair, may be separated into two or more categories and, as in this example, may be categorized as being, short, medium, or long. Short hair, merely for example, may be defined as having a length of 0-4 inches, medium length hair may be defined as having a length of 4-9 inches, and long hair may be defined as having a length of 9 inches and longer.

The amount or density of the user's hair (i.e. the number of strands of hair per unit area of scalp) may also be separated into two or more categories and, as in this example, may be categorized as being, fine, medium, or thick.

The texture of the user's hair or the amount of curliness or lack thereof, may be separated into two or more categories, and as in this example, may be categorized as being straight, wavy, curly, and kinky. Straight hair, for example, may be defined as strands of hair having an arc of less than 15 degrees per inch, and the cross-sectional shape of the hair strand's diameter is circular, wavy hair may be defined as strands of hair having an arc of 15-45 degrees per inch and the cross-sectional shape of the hair strand's diameter is oval, and curly hair may be defined as having strands of hair having an arc of 45 degrees or greater per inch and the cross-sectional shape of the hair strand's diameter is irregular with consistency, and kinky hair may be defined as strands of hair having an arc of 45 degrees or greater per inch and the cross-sectional shape of the hair strand's diameter is irregular shaped without consistency.

The thickness of the user's strands of hair may also be separated into two or more categories and, as in this example, may be categorized as being fine, regular, or thick. Due to the complexity of measuring the actual thickness of the user's strands of hair, however, the thickness of the user's strands of hair may be quantified or categorized in other ways. For example, it may be said that a relationship exists between the actual diameter of the user's strands of hair and the manner, or volume, in which the strands of hair lay on the user's scalp. More specially, the user's strands of hair will fall and rest in an overlapping manner on the user's scalp. The thicker the strands of hair, the more volume and more depth the hair will have. Therefore, by measuring the depth or volume of the hair as it lays on the user's scalp (i.e. from the scalp of the user to the top of the last layer of hair) the thickness of the strands of hair may be categorized. Fine strands of hair, for example, may be apparent in individuals whose depth of hair measures less than 0.5 inches measured from scalp to the last layer of hair, regular strands of hair may be apparent in individuals whose depth of hair measures 0.51" to 0.60" inches measured from scalp to the last layer of hair, and thick strands of hair may be apparent in individuals whose depth of hair measures 0.60" inches or greater from scalp to the last layer of hair.

The user's type of hair, however, may be largely influenced and effected by the hair style, such that the type of hair is made less of a factor or even irrelevant in customizing the hair brush 20. For example, a user's style of hair may include, but is not limited to, altering the user's hair such as with a permanent treatment or hair extensions, adding hair care products such as conditioner, gel or moose, and/or utilizing styling tools, such as a hair dryer, curling iron, hair rollers, hair straightener, etc. Therefore, in determining the type of hair brush 20 to be used with the user's hair, the style of hair may also be considered.

In customizing the hair brush 20 to the user's hair, several features of the hair brush 20 may be altered to obtain the hair brush 20 best suited for the user's hair type. These can include, but need not be limited to, a density of the bristles 26, 102 and/or a length of the bristles 26, 102. For example, other features of the hair brush 20 may be altered, such as the shape of the bristles 26, 102 and a diameter of the bristles 26, 102.

Figure 8:
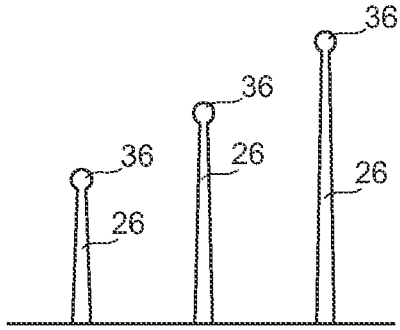
FIG. 8 is a cross-sectional view of short, medium, and long bristles.

For example, depending on the type and/or style of the user's hair, the length of the bristles 26, 102 of the hair brush 20, may be one of several lengths. More specifically, as in the examples disclosed, the bristles 26, 102 may be short, medium or long, as measured from the top of the outside surface 40 of the front part 30 of the body 22 to the tip 36 of the bristles 26 or from the central annular portion 80 to the outer section 108 of the bristles 102, as illustrated in FIG. 8. Short bristles may be approximately 0.876 inches in length or shorter, medium bristles may approximately 0.97-0.877 inches in length, and long bristles 30 may be 0.98 inches or longer.

Figure 9:
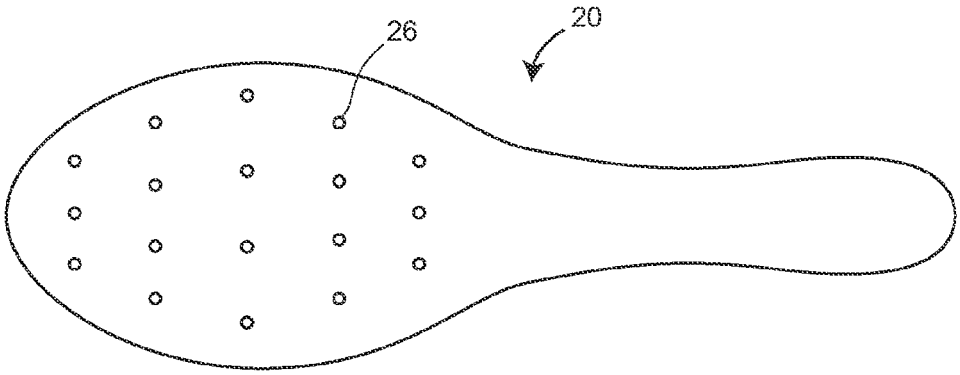
FIG. 9 is a front plan view of a low-density bristle pattern of an oval brush.
Figure 11:
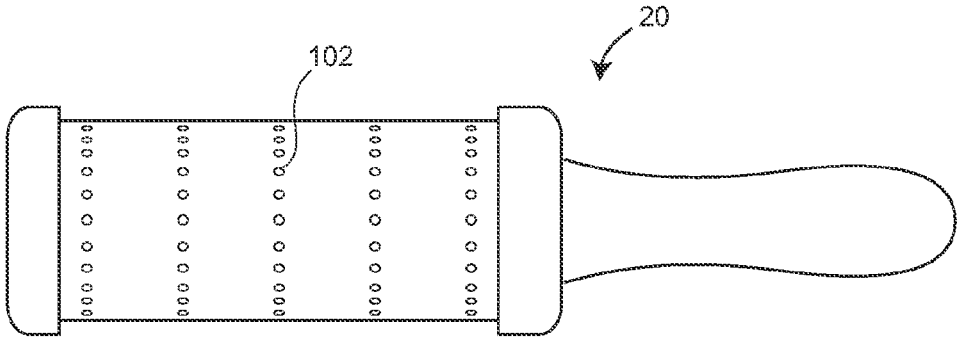
FIG. 11 is a cross-sectional view of a low-density bristle pattern of a round brush.
Figure 12:
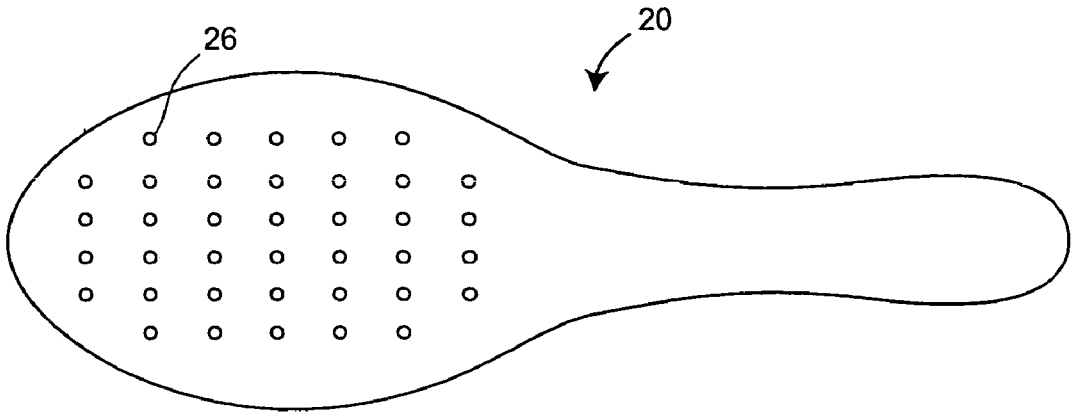
FIG. 12 is a front plan view of a medium-density bristle pattern of an oval brush.
Figure 14:
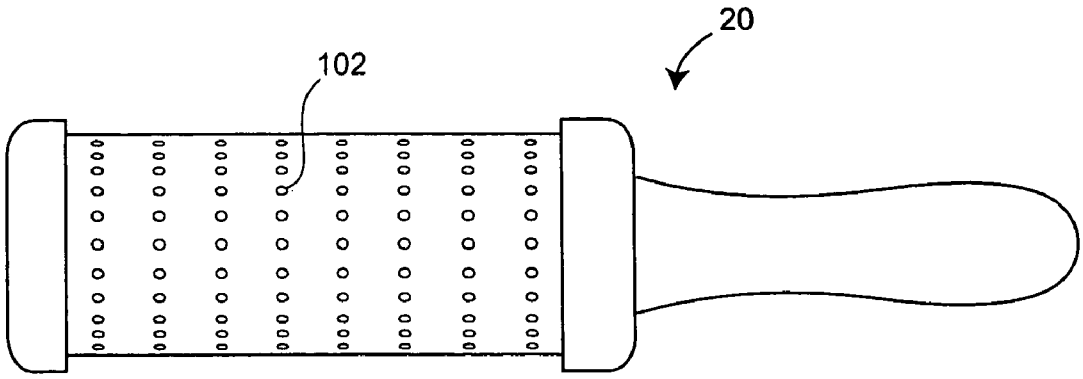
FIG. 14 is a cross-sectional view of a medium-density bristle pattern of a round brush.
Figure 15:
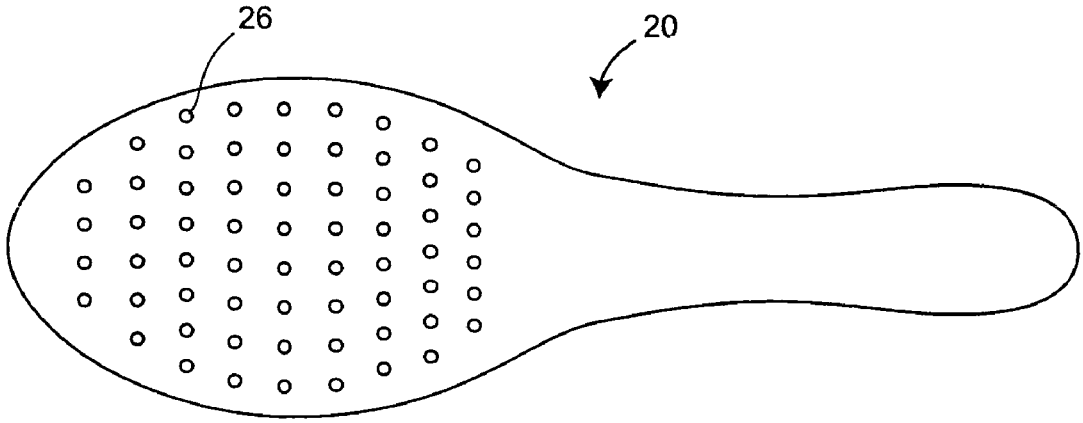
FIG. 15 is a front plan view of a high-density bristle pattern of an oval brush.
Figure 17:
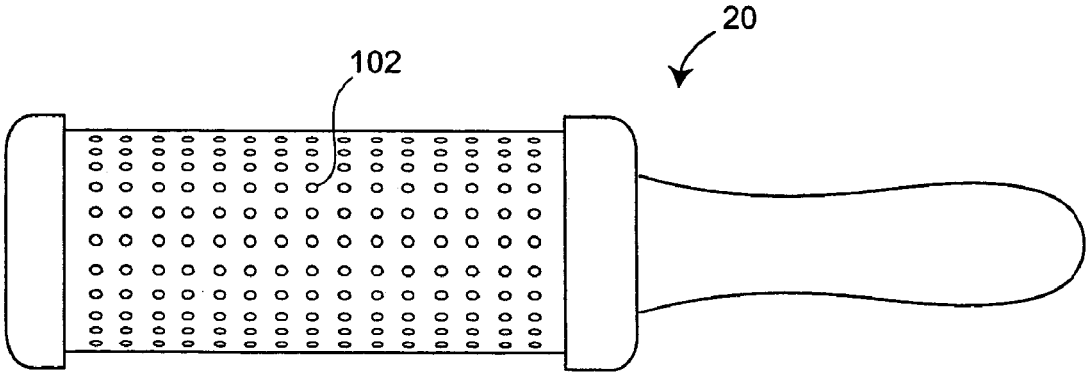
FIG. 17 is a cross-sectional view of a high-density bristle pattern of a round brush.

Similarly, the density of the bristles 26, 102 of the hair brush 20, may vary depending on the type and/or texture of the user's hair. The density may be directly related to the stiffness of the bristle, such that the various stages or categories of densities may correlate to the various stages of stiffness of the bristles. More specifically, as in this example, the hair brush 20 may have a heavy, medium or light density of bristles 26, 102. For example, a hair brush having a heavy density of bristles 30, as illustrated in FIG. 15-17, may have approximately 0.125 to 45" spacing between each bristle or less, a hair brush 20 having a medium density of bristles 26, 102, as illustrated in FIG. 12-14, may have approximately 0.451 to 0.55" spacing between each bristle, and a hair brush having a light density of bristles 26, 102, as illustrated in FIG. 9-11, may have approximately 0.56" to 0.75" spacing between each bristle or more.

Additionally, the diameter and/or shape of the bristles 26, 102 of the hair brush 20, may vary depending on the type and/or texture of the user's hair. The diameter and/or shape may be directly related to the stiffness of the bristle, such that the various stages or categories of diameter and/or shape may correlate to the various stages of stiffness of the bristles. More specifically, as in this example, the hair brush 20 may have a fine, medium or thick diameter and/or shape of bristles 26, 102.

In optimizing the hair brush 20 for the user's type and/or style of hair, a combination of the density of the bristles 26, 102 and the length of the bristles 26, 102, best suited for the user's type and texture of hair may be used. For example, a hair brush having a heavy density of short bristles 26, 102 may be best suited for a person with straight and fine hair. Contrarily, a hair brush 20 having a light density of long bristles 26, 102 may be best suited for a person with curly and thick hair.

It should be understood, however, that in optimizing the hair brush 20 for the user's type and/or texture of hair, not all features of the hair brush 20 need be altered, nor need all the various types of hair be considered. For example, the bristles 26, 102 may only vary in length according to the thickness of the user's strands of hair. Similarly, the density of the bristles 26, 102 may only vary according to the texture of the user's hair. Therefore, the length and/or the density of the bristles 26, 102 may be varied according to the user's length, amount, texture, and/or thickness of hair. For exemplary purposes only, the below Chart A provides examples of combinations of length and/or the density of the bristles 26, 102 that may be used with various types of hair.

CHART A

| TYPE OF HAIR | | HAIR BRUSH BRISTLES | |
|---|---|---|---|
| Texture | Thickness | Length | Density |
| Straight | Fine | Short | High |
| Straight | Medium | Medium | High |
| Straight | Thick | Long | High |
| Wavy | Fine | Short | Medium |
| Wavy | Medium | Medium | Medium |
| Wavy | Thick | Long | Medium |
| Curly | Fine | Short | Low |
| Curly | Medium | Medium | Low |
| Curly | Thick | Long | Low |
| Kinky | Fine | Short | Low |
| Kinky | Medium | Medium | Low |
| Kinky | Thick | Long | Low |

While the above has been described with reference to specific examples which are intended to be illustrative only and not to be limiting of the invention, it will be apparent to those of ordinary skill in the art that changes, additions or deletions may be made to the disclosed embodiments without departing from the spirit and scope of the invention.

What is claimed is:

1. A hair brush comprising:

a body defining a brush head having a front portion, a rear portion, and a plurality of apertures extending through the front portion;

a resiliently deformable cushion pad made of a generally resilient and flexible material and disposed within the head, wherein the cushion pad and the rear portion of the head cooperatively define an air-filled cushioning cavity; and a plurality of bristles each having a base end securely attached to the cushion pad, wherein the bristles extend substantially perpendicular from the cushion pad and through the apertures in the front portion of the head with free ends of the bristles disposed beyond the front portion and outside of the head, wherein the cushion pad is movable from a use position with the cushion pad disposed adjacent the front portion of the head and the plurality of bristles in a fully extended position, to a cleaning position with the cushion pad disposed adjacent the rear portion of the head and at least some of the bristles in a retracted position, wherein the cushion pad has a convex shape with a bowed-out surface adjacent the front portion of the head when the cushion pad is in the use position, the front portion of the head defines a first inner surface, the rear portion of the head defines a second inner surface that is opposite the front inner surface, and the resiliently deformable cushion pad biases the bristle base ends towards the first inner surface, and wherein the head includes a plurality of positioning members spaced apart about a perimeter thereof, the cushion pad includes a plurality of positioning members spaced apart about a perimeter thereof, and the cushion pad positioning members align with and engage the head positioning members to maintain the position and alignment of the cushion pad with respect to the head.

2. The hair brush of claim 1, wherein the body further includes a handle extending from the head.

3. The hair brush of claim 1, wherein the free ends of the plurality of bristles each have a generally spherical shape.

4. The hair brush of claim 1, wherein the free ends of the plurality of bristles are disposed away from an outer surface of the head in the fully extended position and are disposed near the outer surface of the head in the retracted position.

5. The hair brush of claim 1, wherein the front portion of the head further includes a plurality of venting apertures, the rear portion of the head further includes a plurality of venting apertures, the cushion pad further includes a plurality of venting apertures, and the front portion venting apertures, the rear portion venting apertures, and the cushion pad venting apertures are aligned with each other.

6. The hair brush of claim 1, wherein a force exerted on one or more of the bristles urges at least a portion of the cushion pad towards the second inner surface thereby retracting the bristles upon which the force is applied and at least adjacent ones of the bristles to the retracted position.

7. The hair brush of claim 1, wherein the head has at least one stop surface against which the cushion pad perimeter abuts so that, when one or more of the bristles are depressed, the perimeter of the cushion pad is restrained by the stop surface from moving, with the result that at least a portion of the cushion pad from which the depressed bristles extend is deformed from the convex shape as it moves to the cleaning position.

8. The hair brush of claim 7, wherein the at least one stop surface is defined by the rear portion of the head.

9. The hair brush of claim 7, wherein the at least one stop surface is defined by a ledge or protrusion extending inward toward the cavity from the front or rear portion of the head.

10. The hair brush of claim 1, wherein the cushion pad is a single continuous sheet to which all of the bristles are securely attached and from which all of the bristles extend, wherein depressing one of the bristles deforms a portion of the cushion pad from which the depressed bristle extends and from which all transversely, longitudinally, and diagonally adjacent bristles extend.

11. The hair brush of claim 1, wherein the head positioning members protrude into the cavity, the cushion pad positioning members are formed by reliefs or cut-outs in the cushion pad, and the cushion pad reliefs or cut-outs align with, receive, and engage the head positioning members to maintain the position and alignment of the cushion pad with respect to the head.

12. The hair brush of claim 11, wherein the reliefs or cut-outs are angled.

13. The hair brush of claim 12, wherein the angled reliefs or cut-outs have sides that are disposed on either side of the head positioning members.

14. A hair brush comprising:

a body defining a brush head having a front portion, a rear portion, a plurality of apertures extending through the front portion, and at least one stop surface;

a resiliently deformable cushion pad disposed within the head, wherein the cushion pad and the rear portion of the head cooperatively define an air-filled cushioning cavity, wherein the cushion pad has a convex shape with a bowed-out surface facing the front portion of the head, wherein the cushion pad has a perimeter against which the head stop surface abuts, and wherein the cushion pad is a single continuous sheet; and a plurality of bristles each having a base end securely attached to the single cushion pad, wherein all of the bristles extend substantially perpendicular from the single cushion pad and through the apertures in the front portion of the head with free ends of the bristles disposed beyond the front portion and outside of the head, wherein the cushion pad is movable from a use position with the cushion pad disposed adjacent the front portion of the head and the plurality of bristles in a fully extended positions, to a cleaning position with the cushion pad disposed adjacent the rear portion of the head and at least some of the bristles in a retracted position, wherein the free ends of the plurality of bristles are disposed away from an outer surface of the front portion of the head in the fully extended position and are disposed near the outer surface of the head in the retracted position, wherein when one or more of. the bristles are depressed, the perimeter of the cushion pad is restrained by the stop surface from moving, with the result that a portion of the cushion pad from which the depressed bristles extend and from which all transversely, longitudinally, and diagonally adjacent bristles extend is deformed from the convex shape as it moves to the cleaning position, wherein the cushion pad is made of a generally resilient and flexible material selected so that the cushion pad biases the bristle base ends towards the front portion of the head, and wherein the head includes a plurality of positioning members spaced apart about a perimeter thereof, the cushion pad includes a plurality of positioning members spaced apart about the perimeter thereof, and the cushion pad positioning members align with and engage the head positioning members to maintain the position and alignment of the cushion pad with respect to the head.

15. The hair brush of claim 14, wherein the body further includes a handle extending from the head.

16. The hair brush of claim 14, wherein the free ends of the plurality of bristles each have a generally spherical shape.

17. The hair brush of claim 14, wherein the front portion of the head further includes a plurality of venting apertures, the rear portion of the head further includes a plurality of venting apertures, the cushion pad further includes a plurality of venting apertures, and the front portion venting apertures, the rear portion venting apertures, and the cushion pad venting apertures are aligned with each other.

18. The hair brush of claim 14, wherein the at least one stop surface is defined by the rear portion of the head.

19. The hair brush of claim 14, wherein the at least one stop surface is defined by a ledge or protrusion extending inward toward the cavity from the front or rear portion of the head.

20. The hair brush of claim 14, wherein the head positioning members protrude into the cavity, the cushion pad positioning members are formed by reliefs or cut-outs in the cushion pad, and the cushion pad reliefs or cut-outs align with, receive, and engage the head positioning members to maintain the position and alignment of the cushion pad with respect to the head.

21. The hair brush of claim 20, wherein the reliefs or cut-outs are angled.

22. The hair brush of claim 21, wherein the angled reliefs or cut-outs have sides that are disposed on either side of the head positioning members.

* * * * *